US009631638B2

(12) United States Patent
Lin et al.

(10) Patent No.: US 9,631,638 B2
(45) Date of Patent: Apr. 25, 2017

(54) THINNED HEAT DISSIPATION FAN WITH CORE REVERSELY INSTALLED

(71) Applicant: Cooler Master (Kunshan) Co., Ltd., KunShan (CN)

(72) Inventors: Fu-Lung Lin, KunShan (CN); Hui-Hai Yang, KunShan (CN); Tong-Xian Chen, KunShan (CN)

(73) Assignee: COOLER MASTER (KUNSHAN) CO., LTD., Kunshan, JS (CN)

( * ) Notice: Subject to any disclaimer, the term of this patent is extended or adjusted under 35 U.S.C. 154(b) by 316 days.

(21) Appl. No.: 14/559,640

(22) Filed: Dec. 3, 2014

(65) Prior Publication Data

US 2015/0159672 A1 Jun. 11, 2015

(30) Foreign Application Priority Data

Dec. 9, 2013 (CN) ..... 2013 2 0803878 U

(51) Int. Cl.

| | |
|---|---|
| ***F04D 25/06*** | (2006.01) |
| ***F04D 25/08*** | (2006.01) |
| ***F04D 29/62*** | (2006.01) |
| ***F04D 29/64*** | (2006.01) |

(52) U.S. Cl.

CPC ..... *F04D 29/646* (2013.01); *F04D 25/062* (2013.01); *F04D 25/0653* (2013.01); *F04D 29/626* (2013.01)

(58) Field of Classification Search

CPC .. F04D 25/062; F04D 25/0653; F04D 29/626; F04D 25/0613; F04D 25/064; F04D 25/0646; F04D 25/08

USPC ..... 417/354, 420, 423.12, 423.14

See application file for complete search history.

(56) References Cited

U.S. PATENT DOCUMENTS

| | | | | |
|---|---|---|---|---|
| 8,690,552 | B2 * | 4/2014 | Chang | F04D 25/062 415/205 |
| 2006/0192450 | A1 * | 8/2006 | Hsieh | F04D 29/0563 310/90 |
| 2012/0121389 | A1 * | 5/2012 | Chang | F04D 17/16 415/122.1 |

FOREIGN PATENT DOCUMENTS

| | | |
|---|---|---|
| TW | M403046 U | 5/2011 |

* cited by examiner

*Primary Examiner* — Peter J Bertheaud

(74) *Attorney, Agent, or Firm* — Chun-Ming Shih; HDLS IPR SERVICES

(57) ABSTRACT

A thinned heat dissipation fan with core reversely installed includes: a base including a bottom plate and a lateral wall formed at the periphery of the bottom plate; a circuit unit disposed on the bottom plate; a core welded in a core welding hole formed on the bottom plate of the base or welded in a core welding hole of a sleeve seat fastened on the base; and a rotor set including a hub, a plurality of blades disposed at the periphery of the hub, a bearing module and a permanent magnet disposed at the inner sides of the plural blades, wherein the hub is formed with a bearing opening, the bearing module is fastened in the bearing opening, and the core is inserted in the bearing module. The above-mentioned welding means is preferably to be a laser welding means.

4 Claims, 10 Drawing Sheets

THINNED HEAT DISSIPATION FAN WITH CORE REVERSELY INSTALLED

BACKGROUND OF THE INVENTION

Field of the Invention

The present invention relates to a heat dissipation fan, especially to a thinned heat dissipation fan with core reversely installed which is used for dissipating heat generated by an electronic product.

Description of Related Art

A heat dissipation fan is commonly installed in an electronic product such as a desktop computer, a notebook computer and a tablet computer for dissipating heat generated by electronic components.

With the trend of the electronic product being thinner, the thickness of heat dissipation fan is also required to be thinner. Take the Taiwan Patent NO. M403046, title in "Thinned reinforced structure for rotor set of heat dissipation fan" for example; the combination of a core and a metal shaft seat requires a core inserting hole for increasing the combining strength of the core and the metal shaft seat. The inner edge of the above-mentioned core inserting hole is upwardly protruded for clamping and fastening the core, the combining strength may not be enough if the protruded height of the core inserting hole is overly low, however the axial space would be occupied if the core inserting hole is overly protruded. As such, the conventional means for fastening the core does not allow the heat dissipation fan to be thinned.

SUMMARY OF THE INVENTION

The present invention is to provide a thinned heat dissipation fan with core reversely installed, so the thickness of the heat dissipation fan is able to be further thinned, wherein a core is welded and fastened in the fan thereby overcoming the disadvantage of the axial space being occupied by the height of the upwardly-protruded inner edge of the core inserting hole.

Accordingly, the present invention provides a thinned heat dissipation fan with core reversely installed, which includes:

a base, including a bottom plate and a lateral wall formed at the periphery of the bottom plate, wherein the bottom plate is formed with a sleeve opening;

a circuit unit, disposed on the bottom plate and at the outer periphery of the sleeve opening;

a sleeve seat, including a sleeve bottom part and a sleeve lateral part defined at the periphery of the sleeve bottom part, wherein the sleeve bottom part is fastened in the sleeve opening of the base, and the central portion of the sleeve bottom part is formed with a core welding hole;

a core, having the bottom end welded in the core welding hole of the sleeve seat;

a coil set, having the central portion formed with a fasten hole, wherein the sleeve seat is latched and fastened at the inner edge of the fasten hole; and a rotor set, including a hub, a plurality of blades disposed at the periphery of the hub, a bearing module and a permanent magnet disposed at the inner sides of the plural blades, wherein the hub is formed with a bearing opening, the bearing module is fastened in the bearing opening, and the core is inserted in the bearing module.

According to the above-mention thinned heat dissipation fan with core reversely installed, wherein the bottom end of the core is welded in the core welding hole of the sleeve seat with a laser welding means.

According to the above-mention thinned heat dissipation fan with core reversely installed, wherein the coil set includes a frame, a plurality of insulation racks disposed on the frame and a plurality of coils correspondingly wound on the plural insulation racks; and the fasten hole is formed at the center of the frame and fastened on the sleeve lateral part of the sleeve seat with a tightly fitting means.

According to the above-mention thinned heat dissipation fan with core reversely installed, wherein the hub is installed with a plastic fasten member for fastening the bearing module in the bearing opening.

According to the above-mention thinned heat dissipation fan with core reversely installed, wherein the bottom plate of the base is a metal plate, and the circuit unit includes a dielectric layer disposed on the bottom plate, a circuit layer formed on the dielectric layer and at least a control member disposed on the circuit layer.

Accordingly, the present invention provides a thinned heat dissipation fan with core reversely installed, which includes:

a base, including a bottom plate and a lateral wall formed at the periphery of the bottom plate, wherein the bottom plate is formed with a core welding hole and a plurality of fasten pieces upwardly protruded and arranged at the outer side of the core welding hole;

a circuit unit, disposed on the bottom plate;

a core, having the bottom end welded in the core welding hole of the bottom plate;

a coil set, having the central portion formed with a fasten hole, wherein the plural fasten pieces are latched and fastened at the inner edge of the fasten hole; and a rotor set, including a hub, a plurality of blades disposed at the periphery of the hub, a bearing module and a permanent magnet disposed at the inner sides of the plural blades, wherein the hub is formed with a bearing opening, the bearing module is fastened in the bearing opening, and the core is inserted in the bearing module.

According to the above-mention thinned heat dissipation fan with core reversely installed, wherein the bottom end of the core is welded in the core welding hole of the bottom plate with a laser welding means.

According to the above-mention thinned heat dissipation fan with core reversely installed, wherein the bottom plate of the base is a metal plate, and the plural fasten pieces are formed through punching the bottom plate, wherein the coil set includes a frame, a plurality of insulation racks disposed on the frame and a plurality of coils correspondingly wound on the plural insulation racks; and the fasten hole is formed at the center of the frame and fastened on the plural fasten pieces with a tightly fitting means.

According to the above-mention thinned heat dissipation fan with core reversely installed, wherein the hub is installed with a plastic fasten member for fastening the bearing module in the bearing opening.

According to the above-mention thinned heat dissipation fan with core reversely installed, wherein the bottom plate of the base is a metal plate, and the circuit unit includes a dielectric layer disposed on the bottom plate, a circuit layer formed on the dielectric layer and at least a control member disposed on the circuit layer.

Advantages achieved by the present invention are as followings: the heat dissipation fan provided by the present invention utilizes a core which is reversely installed, the core is fastened on the base directly or through the sleeve seat with a laser welding means; and comparing to prior art, the axial space occupied by the height of the upwardly-protruded inner edge of the core inserting hole can be reduced, so the height of the heat dissipation fan can be reduced.

DETAILED DESCRIPTION OF THE INVENTION

Preferred embodiments of the present invention will be described with reference to the drawings.

Figure 1:
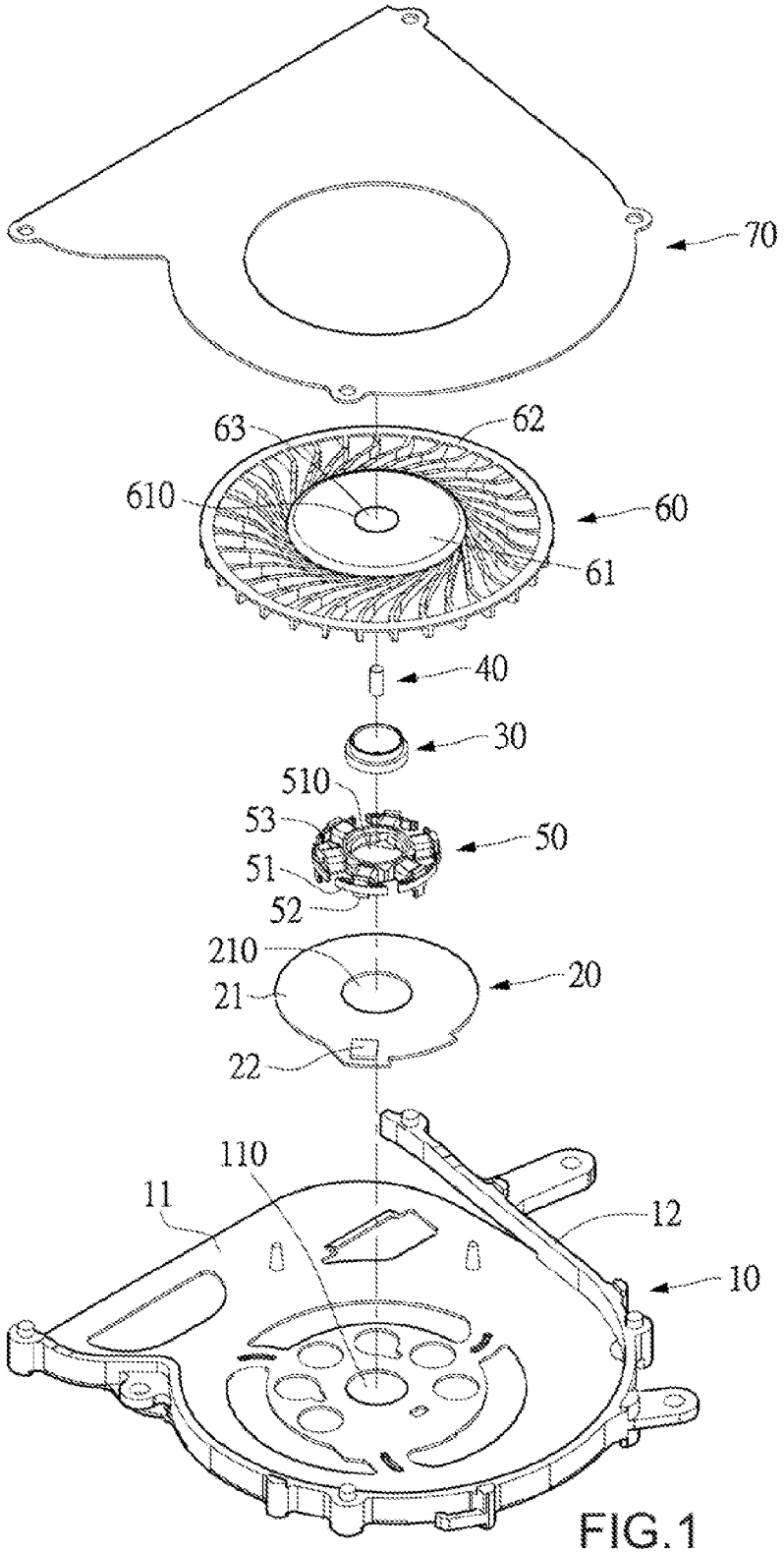
FIG. 1 is a perspective exploded view showing a thinned heat dissipation fan with core reversely installed according to a first embodiment of the present invention.
Figure 2:
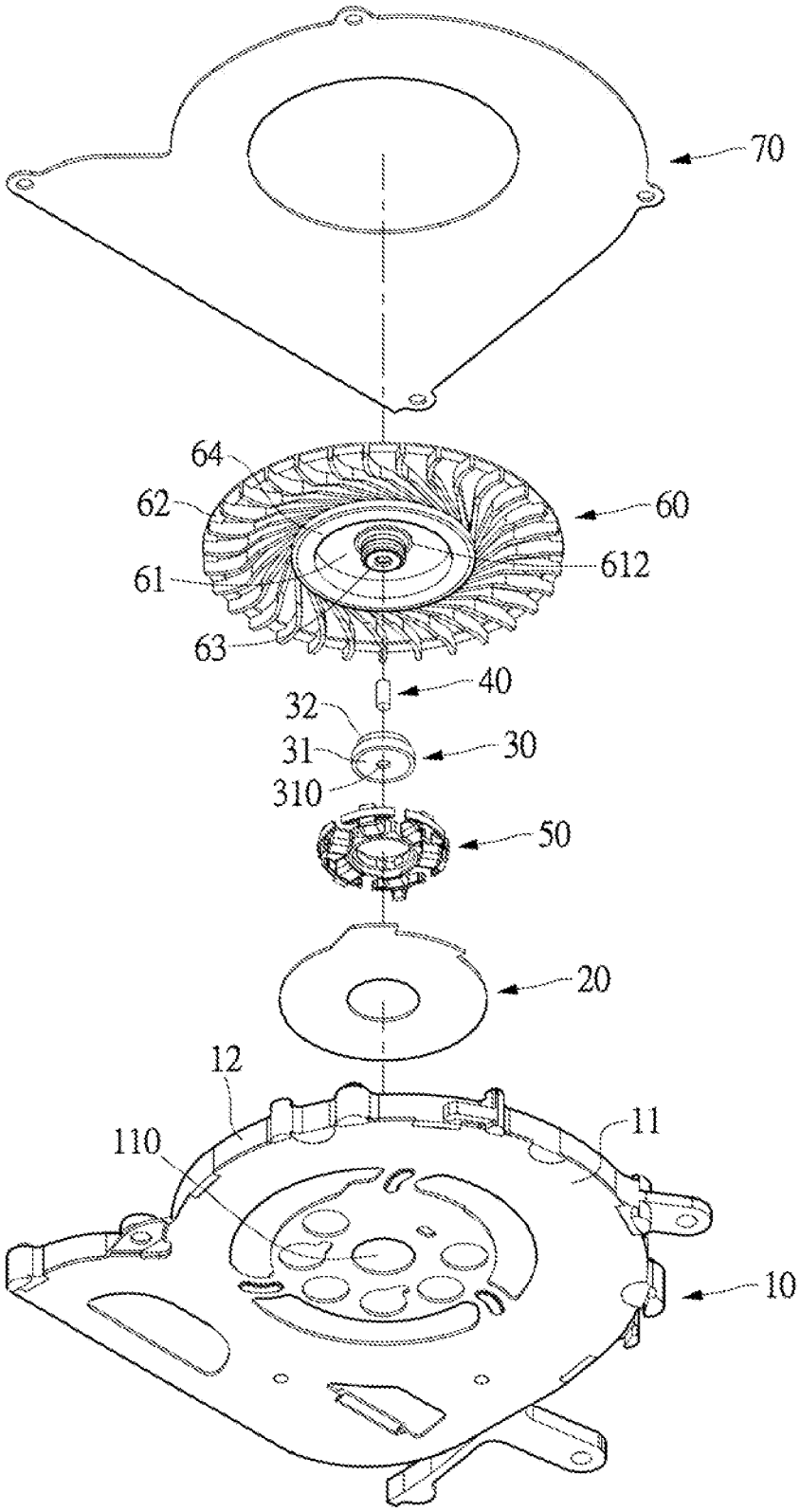
FIG. 2 is another perspective exploded view showing the thinned heat dissipation fan with core reversely installed according to the first embodiment of the present invention.

Please refer to FIG. 1 and FIG. 2, the present invention provides a thinned heat dissipation fan with core reversely installed, which can be abbreviated as a heat dissipation fan and includes a base 10, a circuit unit 20, a sleeve seat 30, a core 40, a coil set 50, a rotor set 60 and a cover plate 70.

The base 10 includes a bottom plate 11 and a lateral wall 12 formed at the periphery of the bottom plate 11. The cover plate 70 is covered on top of the base 10 and fastened on the lateral wall 12. The bottom plate 11 is formed with a sleeve opening 110. According to this embodiment, the bottom plate 11 can be a metal plate member, and the lateral wall 12 is formed at the partial periphery of the bottom plate 11 with respect to the actual needs.

The circuit unit 20 is disposed on the bottom plate 11 and at the outer periphery of the sleeve opening 110. According to this embodiment, the circuit unit 20 includes a circuit board 21 and at least a control member 22 installed on the circuit unit 20. The above-mentioned coil set 50 is electrically connected to the circuit board 21. The central portion of the circuit board 21 is formed with a penetrated hole 210 for being matched with the sleeve seat 30.

The sleeve seat 30 includes a sleeve bottom part 31 and a sleeve lateral part 32 defined at the periphery of the sleeve bottom part 31. The sleeve bottom part 31 is fastened in the sleeve opening 110 of the base 10, and the central portion of the sleeve bottom part 31 is formed with a core welding hole 310. According to this embodiment, the sleeve seat 30 is preferably to be a metal seat member, and the periphery thereof is formed with engaging patterns, and the sleeve seat 30 is able to be latched in the sleeve opening 110 of the base 10 with a tightly fitting means. Or, the sleeve seat 30 can also be fastened in the sleeve opening 110 of the bottom plate 11 with a plastic injection means, wherein the dimension of the sleeve opening is slightly larger than the dimension of the sleeve seat 30 made through the plastic injection means, thereby providing a space allowing plastic to be engaged with the sleeve seat 30 and the sleeve opening of the bottom plate 11. The thickness of the sleeve bottom part 31 can be equal to the thickness of the bottom plate 11 of the base 10.

Figure 3:
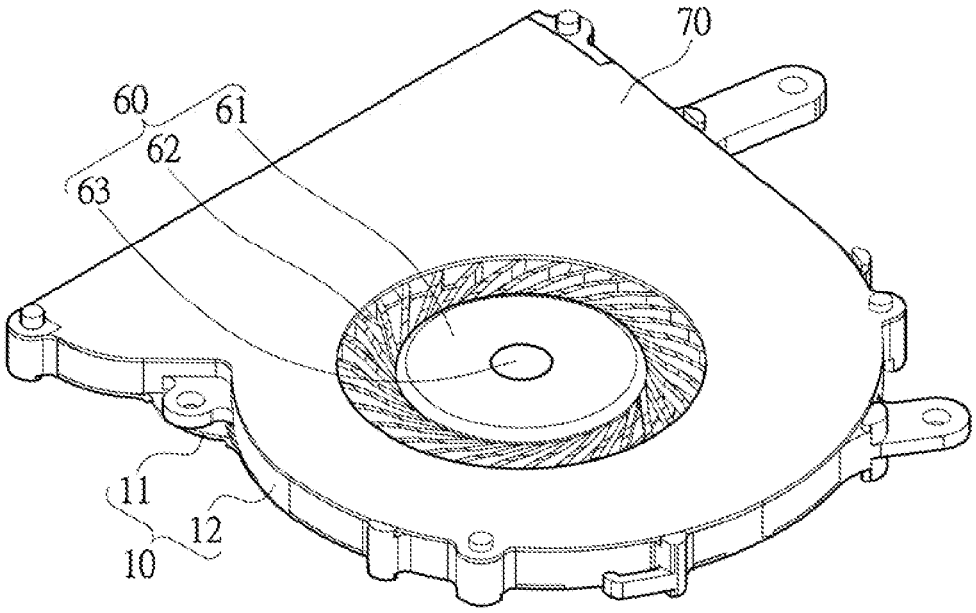
FIG. 3 is a perspective view showing the assembly of the thinned heat dissipation fan with core reversely installed according to the first embodiment of the present invention.
Figure 4:
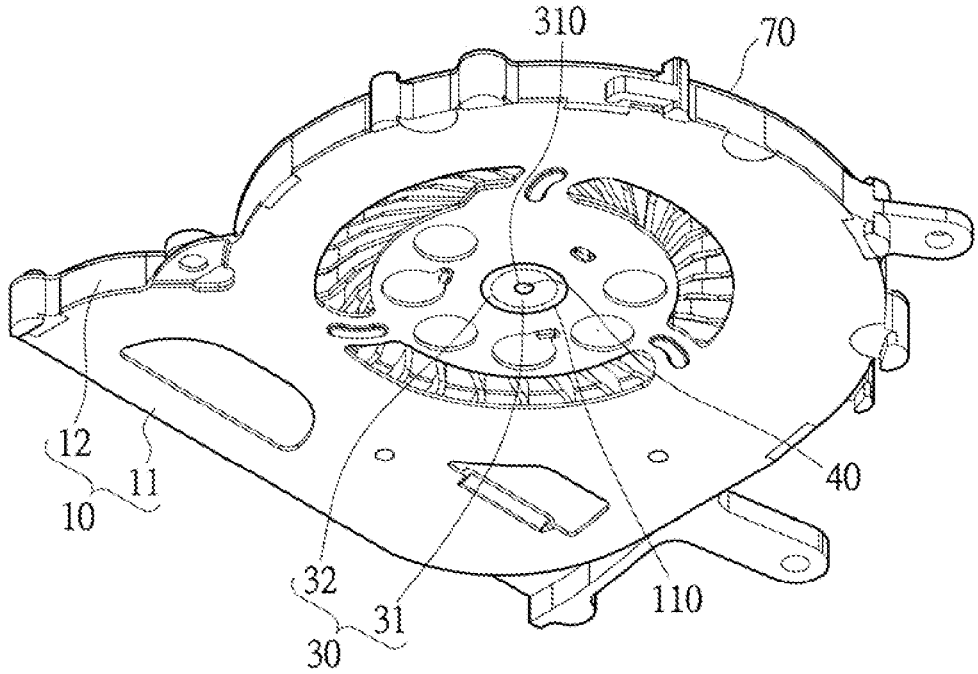
FIG. 4 is another perspective view showing the assembly of the thinned heat dissipation fan with core reversely installed according to the first embodiment of the present invention.

Please refer to FIG. 3 and FIG. 4, which are perspective views showing the assembly of the present invention; for reducing the thickness of the heat dissipation fan, one technical feature of the present invention is that the bottom end of the core 40 is welded in the core welding hole 310 of the sleeve seat 30. The welding means is preferably to be a laser welding means so as to replace the conventional dispensing riveting or injecting covering means. The advantage of laser welding is as following: the automated welding is easy to be processed thereby providing a stable welding performance; the area affected by heat is relatively small thereby generating a smaller deformation; and the welding is able to be rapidly processed thereby being suitable for massive production; thus, the laser welding means is suitable to be adopted for combining and producing the heat dissipation fan. In addition, according to this embodiment, the laser welding operation for the core 40 and the sleeve seat 30 can be separated from other components of the heat dissipation fan.

As shown in FIG. 1 and FIG. 2, the central portion of the coil set 50 is formed with a fasten hole 510, and the sleeve seat 30 is latched and fastened at the inner edge of the fasten hole 510. According to this embodiment, the coil set 50 includes a frame 51 made of a metal material, a plurality of insulation racks 52 disposed on the frame 51, and a plurality of coils 53 corresponding wound on the plural insulation racks 52. The fasten hole 510 is formed at the center of the frame 51 and fastened at the sleeve lateral part 32 of the sleeve seat 30 with a tightly fitting means.

The rotor set 60 includes a hub 61, a plurality of blades 62 disposed at the periphery of the hub 61, a bearing module 63 and a permanent magnet 64 disposed at the inner sides of the plural blades 62. The hub 61 is formed with a bearing opening 610, the bearing module 63 is fastened in the bearing opening 610, and the core 40 is inserted in the bearing module 63. As shown in FIG. 2, according to this embodiment, the hub 61 is installed with a plastic fasten member 612 for fastening the bearing module 63 in the bearing opening 610.

Figure 5:
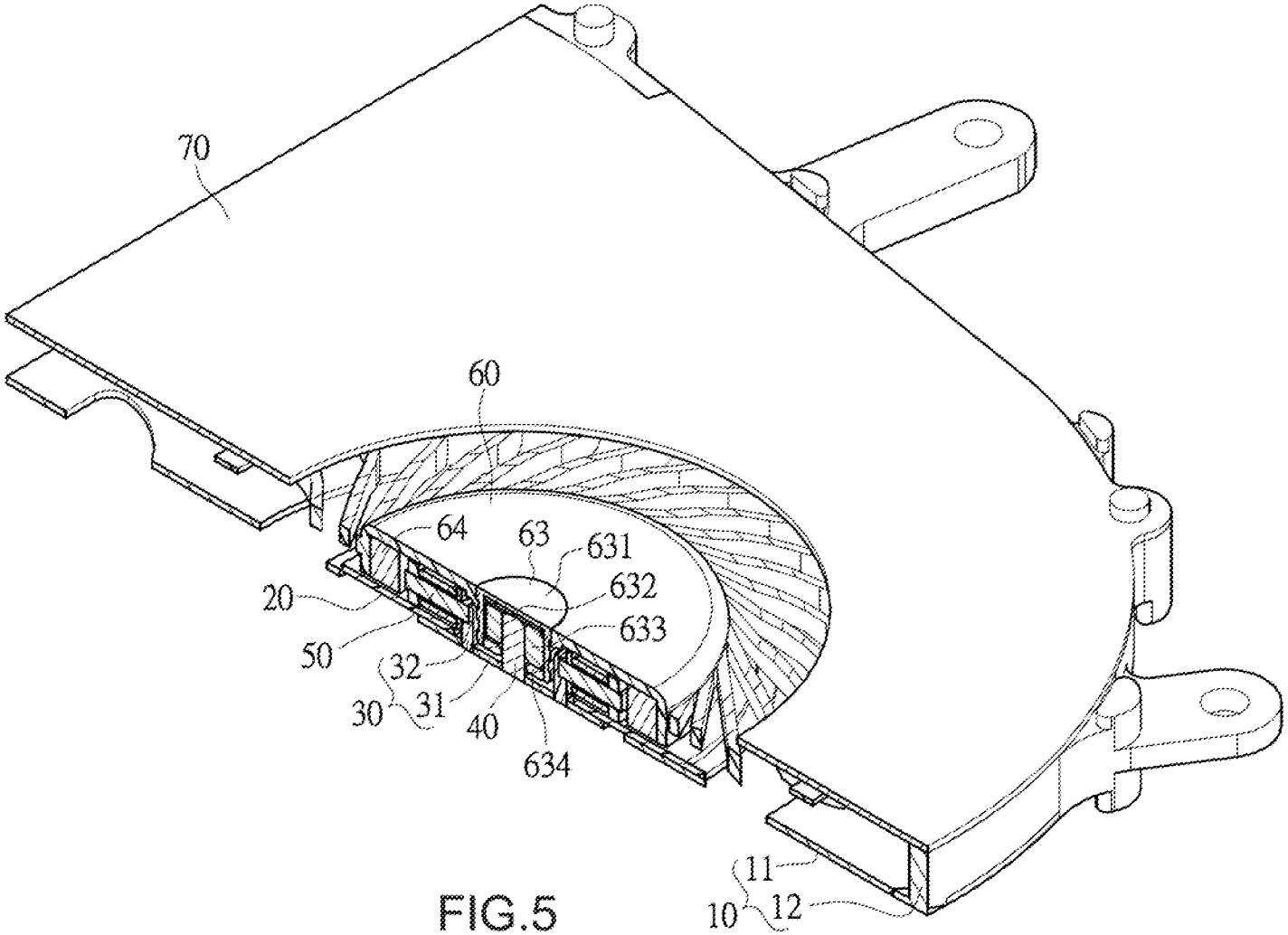
FIG. 5 is a cross sectional view showing the thinned heat dissipation fan with core reversely installed according to the first embodiment of the present invention.
Figure 6:
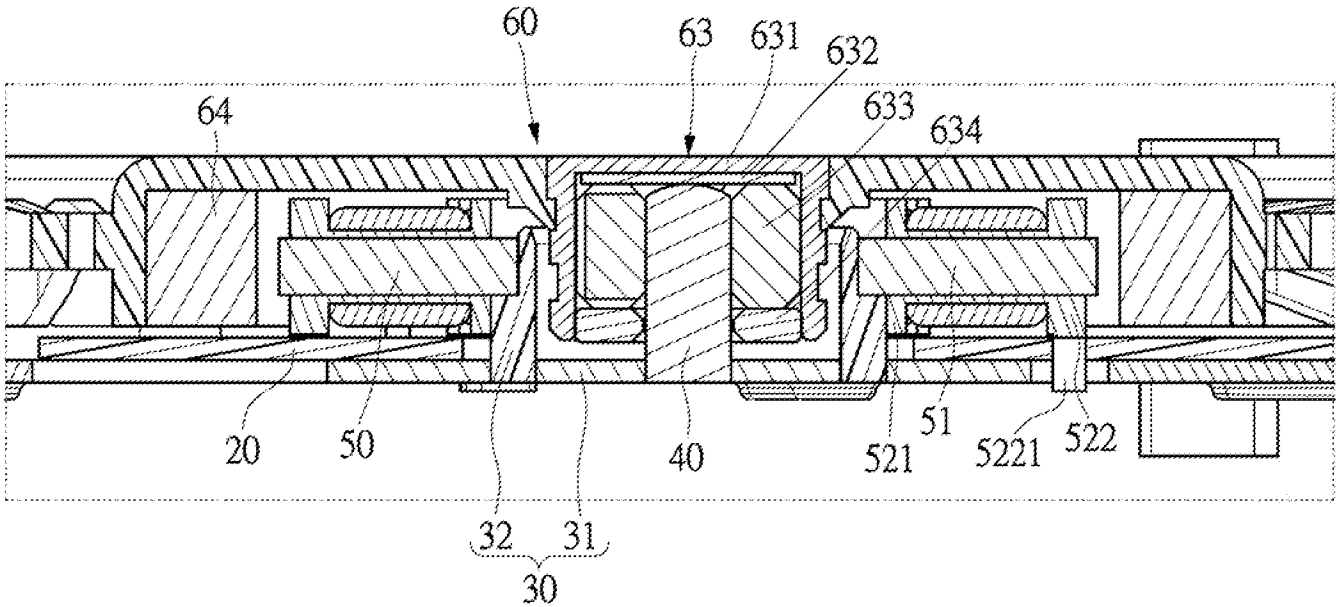
FIG. 6 is a partially enlarged cross sectional view showing the thinned heat dissipation fan with core reversely installed according to the first embodiment of the present invention.

Please refer to FIG. 5 and FIG. 6, which are cross sectional views showing the heat dissipation fan according to the present invention. The above-mentioned bearing module 63 includes a shaft tube 631, a pad 632 disposed at the inner top surface of the shaft tube 631, a bearing 633 and an end cover 634. The bottom end of the core 40 is welded on the sleeve seat 30, and the top end of the core 40 is abutted against the pad 632 of the bearing module 63, therefore the above-mentioned arrangement can be defined as the core being reversely installed. The whole height of the heat dissipation fan is equal to the sum defined by the height of the core 40, the thickness of the pad 632 and the top wall of the shaft tube 631, thereby enabling the heat dissipation fan to be thinned according to this embodiment.

As shown in FIG. 6, according to this embodiment, the cross section of the insulation rack 52 is formed in an H-like shape and sleeved at the outer periphery of the frame 51, and the frame 51 is protruded from the inner side of the insulation rack 52. The insulation rack 52 is formed with an inner wall 521 and an outer wall 522. According to this embodiment, the outer side defined at the top edge of the sleeve lateral part 32 of the sleeve seat 30 is formed with a fall, and sleeve lateral part 32 is latched and fastened at the inner side of the frame 51 and the inner wall 521 of the insulation rack 52. In addition, the outer wall 522 is extended with a pin 5221 for being inserted in the circuit board 21 of the circuit unit 20 thereby enhancing the structural stability. However, the scope of the present invention is not limited to the above-mentioned arrangement, for example the sleeve lateral part 32 of the sleeve seat 30 can be formed with no fall and directly latched and fastened at the inner side of the frame 51 or the inner wall 521 of the insulation rack 52.

Figure 6A:
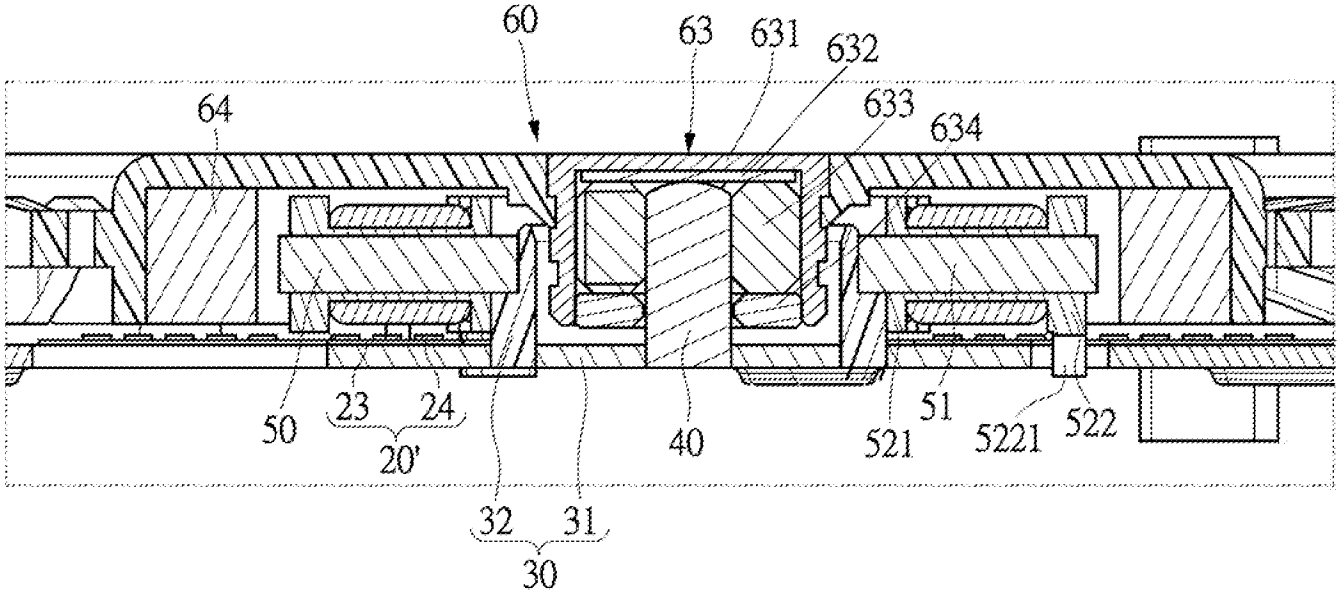
FIG. 6A is another cross sectional view showing the thinned heat dissipation fan with core reversely installed according to the first embodiment of the present invention.

Please refer to FIG. 6A, which is a cross sectional view showing the thinned heat dissipation fan with core reversely installed according an alternative of the first embodiment of the present invention. The difference between this alternative embodiment and the previous embodiment is that a different circuit unit 20' is adopted, such as an LED aluminum substrate disposed on the top surface of the metal-made bottom plate 11; the circuit unit 20' includes a dielectric layer 23 disposed on the bottom plate 11, a circuit layer 24 formed on the dielectric layer 23 and at least a control member (same as the previous embodiment therefore not shown in the figure) disposed on the circuit layer 24. Wherein, the dielectric layer 23 is a layer of heat conductive dielectric material having low thermal resistance. The circuit layer 24 can be a copper foil processed with an etching treatment for forming printed circuits, thereby allowing each section of the component to be mutually connected. The thickness of the circuit layer 24 can be altered with respect to the required carrying current, and generally the thickness is 35 μm~280 μm. The advantage of the circuit unit 20' is that the height of the heat dissipation fan is able to be further reduced comparing to the previous embodiment.

Moreover, another alternative is that the bottom plate 11 can be a dielectric substrate, for example a ceramic substrate, so the above-mentioned dielectric layer is not required, thereby allowing the circuit layer to be directly formed on the dielectric substrate.

Figure 7:
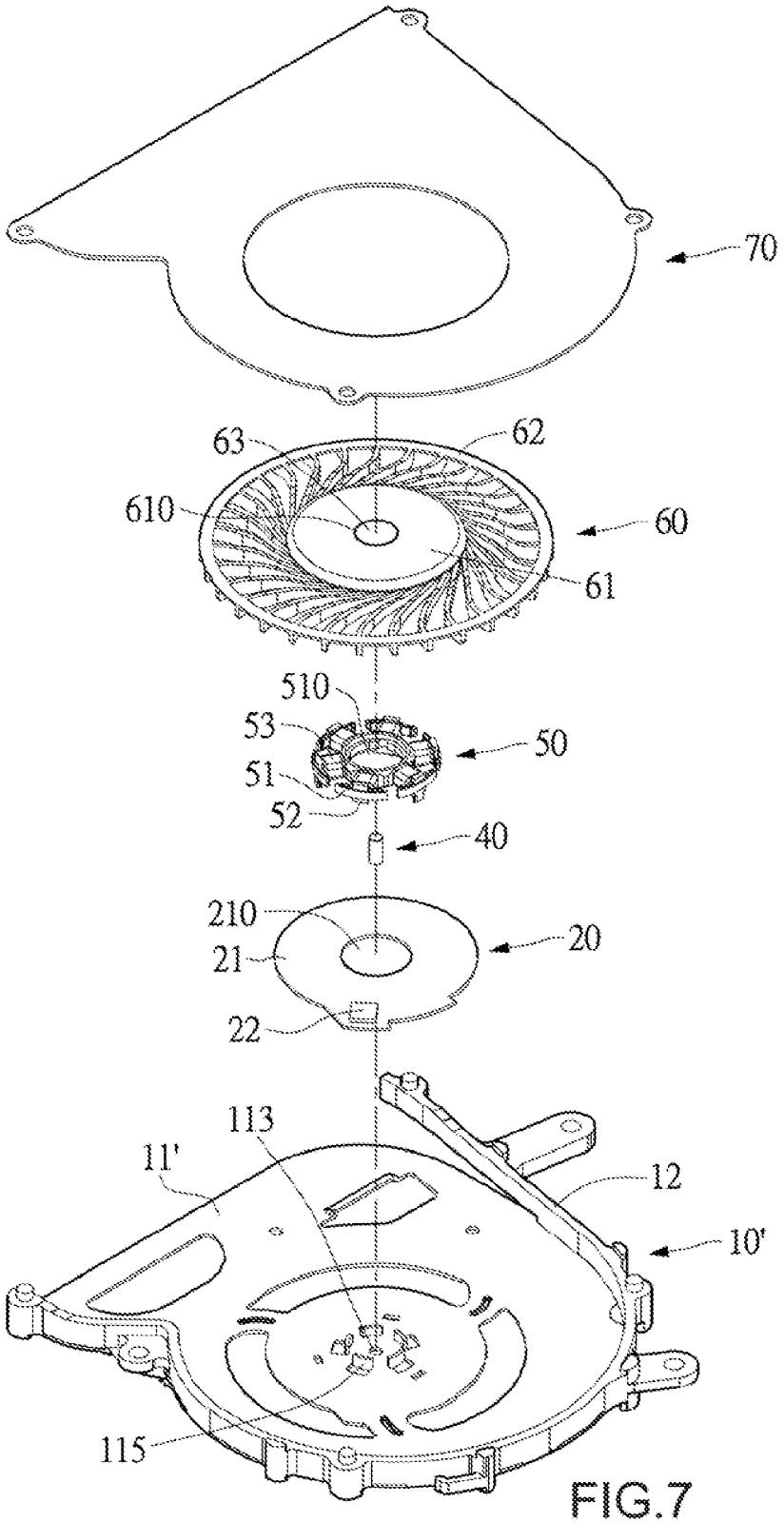
FIG. 7 is a perspective exploded view showing the thinned heat dissipation fan with core reversely installed according to a second embodiment of the present invention.
Figure 8:
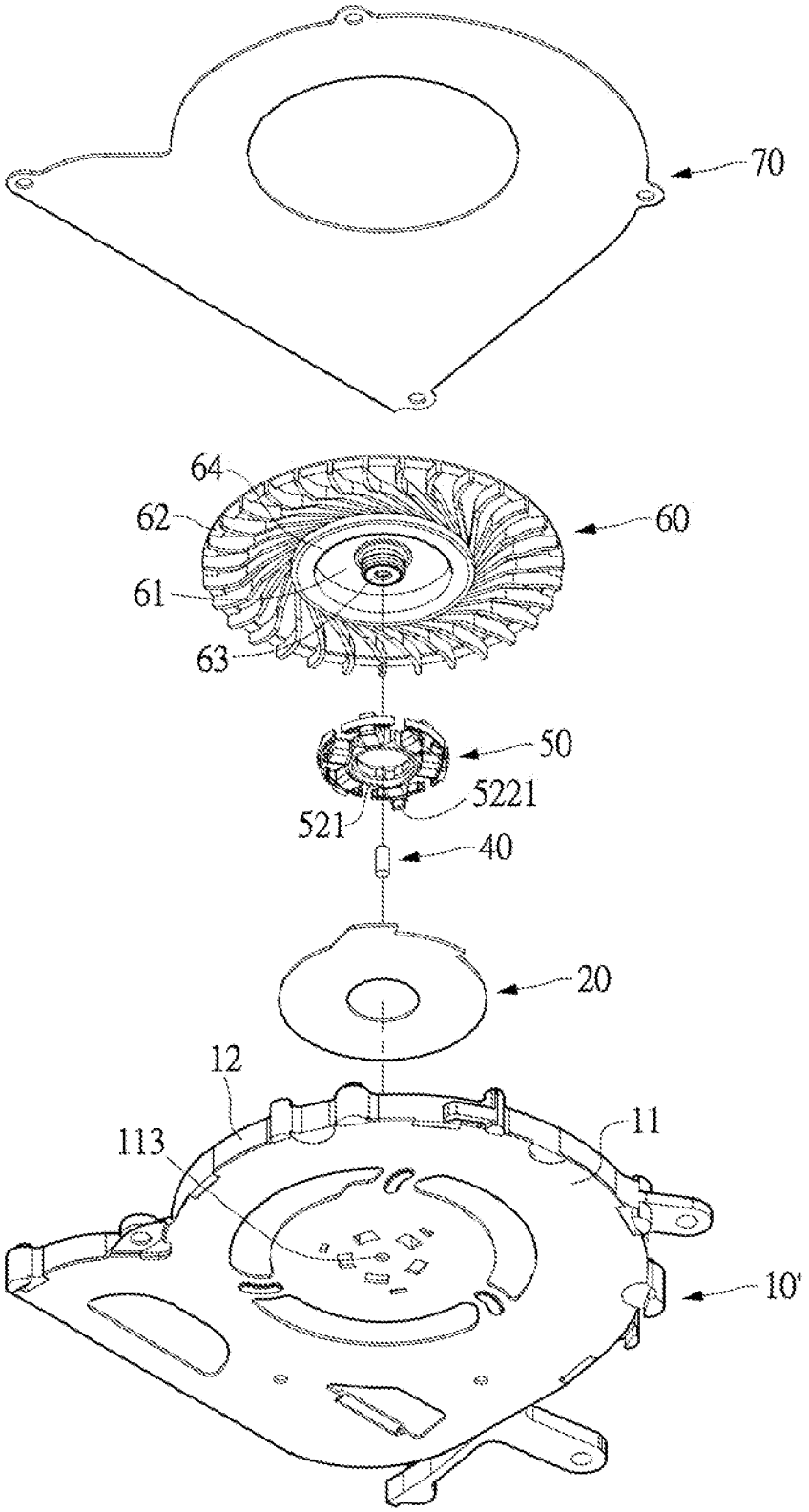
FIG. 8 is another perspective exploded view showing the thinned heat dissipation fan with core reversely installed according to the second embodiment of the present invention.

Please refer to FIG. 7 and FIG. 8, which are perspective exploded views showing the thinned heat dissipation fan with core reversely installed according to a second embodiment of the present invention. Comparing to the first embodiment, the main objective of this embodiment is to drop the above-mentioned sleeve seat 30 and reduce the components of the heat dissipation fan. According to this embodiment, the heat dissipation fan includes a base 10', a circuit unit 20, a core 40, a coil set 50, a rotor set 60 and a cover plate 70.

The base 10' includes a bottom plate 11' formed as a metal plate member and a lateral wall formed at the periphery of the bottom plate 11'. The bottom plate 11' is formed with a core welding hole 113 and a plurality of fasten pieces 115 upwardly protruded and arranged at the outer side of the core welding hole 113. The circuit unit 20 is disposed on the bottom plate 11'. According to this embodiment, the bottom plate 11' is a metal plate member, and the plural fasten pieces 115 are preferably to be formed through punching the bottom plate 11'. The coil set 50 includes a frame 51 made of a metal material, a plurality of insulation racks 52 disposed on the frame 51 and a plurality of coils 53 correspondingly wound on the plural insulation racks 52. The central portion of the coil set 50 is formed with a fasten hole 510, and the fasten hole 510 is formed at the center of the frame 51 and fastened on the plural fasten pieces 115 with a tightly fitting means.

Figure 9:
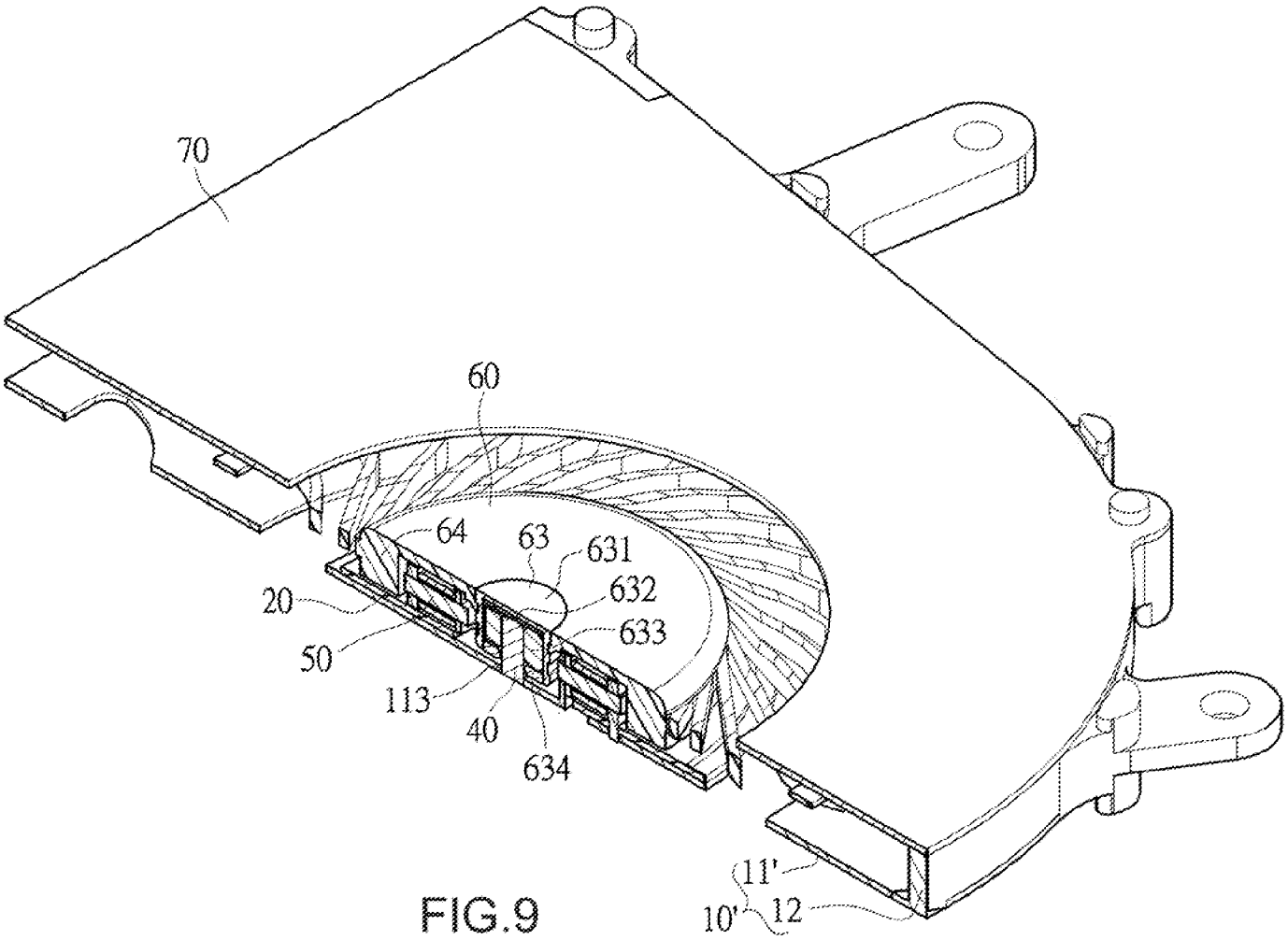
FIG. 9 is a cross sectional view showing the thinned heat dissipation fan with core reversely installed according to the second embodiment of the present invention.
Figure 10:
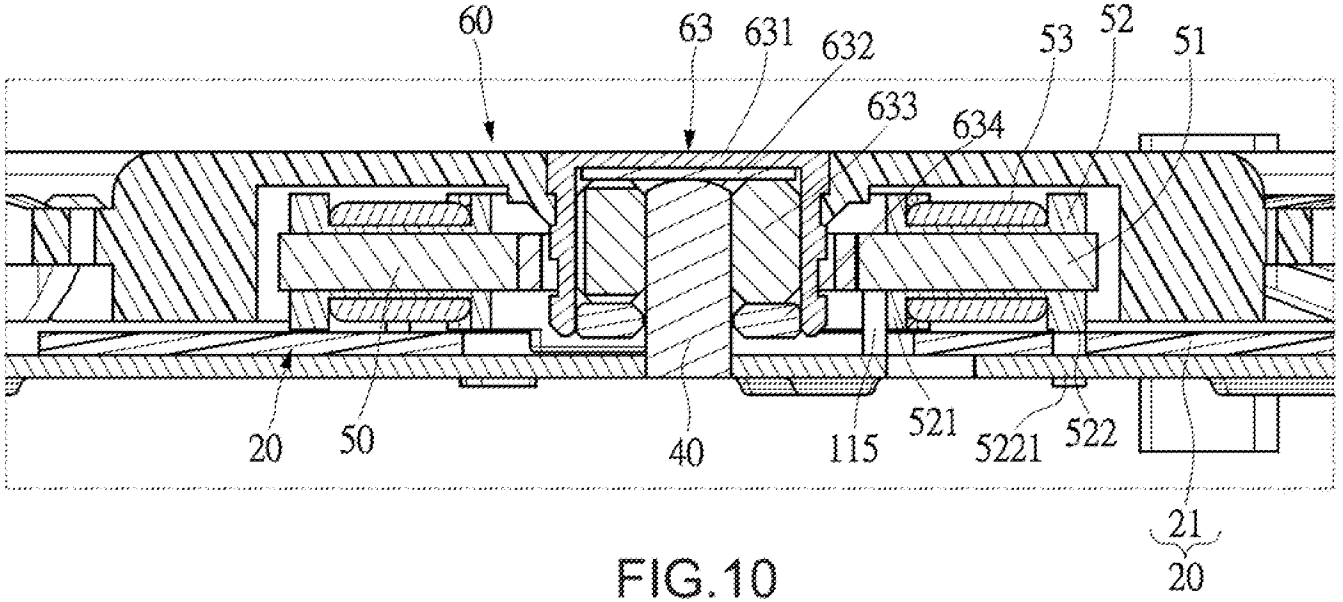
FIG. 10 is a partially enlarged cross sectional view showing the thinned heat dissipation fan with core reversely installed according to the second embodiment of the present invention.

Please refer to FIG. 9 and FIG. 10, which are cross sectional views showing the assembly according to the second embodiment of the present invention. According to this embodiment, the core 40 is directly welded in the core welding hole 113 of the bottom plate 11', thus a sleeve seat is not required comparing to the first embodiment. The assembly of the rotor set 60 is the same as the previous embodiment, and the core 40 is inserted in the bearing module 63 of the rotor set 60.

As shown in FIG. 7 and FIG. 8, the plural fasten pieces 115 are latched and fastened at the inner edge of the fasten hole 510. As shown in FIG. 9 and FIG. 10, a corner is defined by the inner surface of the coil set 50 and the portion of the frame 51 protruded from the inner wall 521 of the insulation rack 52, so according to this embodiment, the fasten pieces 115 are preferably to be latched at the inner edge of the inner wall 521 of the insulation rack 52 and upwardly abutted against the frame 51. As such, a space defined between the frame 51 and the bearing module 63 is not occupied comparing to the previous embodiment. In addition, the pin 5221 of the outer wall 522 of the insulation rack 52 is inserted in the circuit board 21 of the circuit unit 20 thereby enhancing the structural stability.

The rotor set 60 includes a hub 61, a plurality of blades 62 disposed at the periphery of the hub 61, a bearing module 63 and a permanent magnet 64 disposed at the inner sides of the plural blades 62. The hub 61 is formed with a bearing opening 610, the bearing module 63 is fastened in the bearing opening 610, and the core 40 is inserted in the bearing module 63.

Based on what has been disclosed above, advantages achieved by the present invention are as followings: the heat dissipation fan provided by the present invention utilizes a core which is reversely installed, the core is fastened on the base directly or through the sleeve seat with a laser welding means; comparing to prior art, the axial space occupied by the height of the upwardly-protruded inner edge of the core inserting hole can be reduced; moreover, the novel structure provided by the present invention allows the blade of the heat dissipation fan to be thinned and allows the massive production to be processed; furthermore, with the alternative design of the circuit unit, the thickness can be further reduced through adopting the dielectric layer directly disposed on the metal-made substrate and the circuit layer comparing to the conventional circuit board.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A thinned heat dissipation fan with core reversely installed, including:

a base, including a bottom plate and a lateral wall formed at the periphery of the bottom plate, wherein the bottom plate being formed with a core welding hole and a plurality of fasten pieces upwardly protruded and arranged at an outer side of the core welding hole;

a circuit unit, disposed on the bottom plate;

a core, having a bottom end welded in the core welding hole of the bottom plate;

a coil set, having a central portion formed with a fasten hole, wherein the plural fasten pieces being latched and fastened at an inner edge of the fasten hole; and a rotor set, including a hub, a plurality of blades disposed at the periphery of the hub, a bearing module and a permanent magnet disposed at inner sides of the plural blades, wherein the hub being formed with a bearing opening, the bearing module being fastened in the bearing opening, and the core being inserted in the bearing module, wherein the bottom plate of the base is a metal plate, and the plural fasten pieces are formed through punching the bottom plate, wherein the coil set includes a frame, a plurality of insulation racks disposed on the frame and a plurality of coils correspondingly wound on the plural insulation racks; and the fasten hole is formed at the center of the frame and fastened on the plural fasten pieces with a tightly fitting means.

2. The thinned heat dissipation fan with core reversely installed according to claim 1, wherein the bottom end of the core is welded in the core welding hole of the bottom plate with a laser welding means.

3. The thinned heat dissipation fan with core reversely installed according to claim 1, wherein the hub is installed with a plastic fasten member for fastening the bearing module in the bearing opening.

4. The thinned heat dissipation fan with core reversely installed according to claim 1, wherein the circuit unit includes a dielectric layer disposed on the bottom plate, a circuit layer formed on the dielectric layer and at least a control member disposed on the circuit layer.

* * * * *